US009261815B2

(12) United States Patent
Nakaue

(10) Patent No.: US 9,261,815 B2
(45) Date of Patent: Feb. 16, 2016

(54) CONTAINER AND IMAGE FORMING APPARATUS

(71) Applicant: KYOCERA Document Solutions Inc., Osaka-shi, Osaka (JP)

(72) Inventor: Takahisa Nakaue, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/381,811

(22) PCT Filed: Feb. 21, 2013

(86) PCT No.: PCT/JP2013/000974

§ 371 (c)(1),
(2) Date: Aug. 28, 2014

(87) PCT Pub. No.: WO2013/136675

PCT Pub. Date: Sep. 19, 2013

(65) Prior Publication Data

US 2015/0043932 A1 Feb. 12, 2015

(30) Foreign Application Priority Data

Mar. 13, 2012 (JP) ..... 2012-055319

(51) Int. Cl.
*G03G 15/10* (2006.01)
*G03G 15/08* (2006.01)

(52) U.S. Cl.
CPC ..... *G03G 15/086* (2013.01); *G03G 15/0853* (2013.01); *G03G 15/0865* (2013.01); *G03G 15/0891* (2013.01); *G03G 15/0824* (2013.01)

(58) Field of Classification Search
CPC ..... G03G 15/0829; G03G 15/0848; G03G 15/0849; G03G 15/0853; G03G 15/0856; G03G 15/086
USPC ..... 399/27, 30, 61, 62, 63
See application file for complete search history.

(56) References Cited

U.S. PATENT DOCUMENTS

2007/0201886 A1* 8/2007 Watanabe et al. ..... 399/27
2007/0286645 A1* 12/2007 Hayashi ..... 399/262

(Continued)

FOREIGN PATENT DOCUMENTS

EP 2 527 925 11/2012
EP 2 587 315 1/2013

(Continued)

OTHER PUBLICATIONS

International Preliminary Report on Patentability.

(Continued)

*Primary Examiner* — Benjamin Schmitt
(74) *Attorney, Agent, or Firm* — Gerald E. Hespos; Michael J. Porco; Matthew T. Hespos

(57) ABSTRACT

The present application discloses a container including: a housing including a primary portion for storing developer, and a secondary portion, which projects from the primary portion and is connected to a developing device; a conveying mechanism which conveys the developer in the primary portion to the secondary portion; and a detector which detects a state of the developer. The primary portion includes a facing wall which is situated at a boundary between the primary and secondary portions so that the facing wall faces a flow of the developer moving toward the secondary portion. The developer includes a flowing portion under the conveyance to the secondary portion by the conveying mechanism, and an adhering portion defined by an adhering layer made of developer adhered to the facing wall. The detector detects a decrease of the flowing portion and a decrease of the adhering portion individually.

13 Claims, 18 Drawing Sheets

(56) References Cited

U.S. PATENT DOCUMENTS

| | | | |
|---|---|---|---|
| 2009/0257785 | A1 | 10/2009 | Okuda et al. |
| 2013/0101318 | A1 | 4/2013 | Shimizu et al. |

FOREIGN PATENT DOCUMENTS

| | | |
|---|---|---|
| JP | 61-198025 | 9/1986 |
| JP | 02-079063 | 3/1990 |
| JP | 09-062147 | 3/1997 |
| JP | 2003-228227 | 8/2003 |
| JP | 2005-338326 | 12/2005 |
| JP | 2008-052015 | 3/2008 |
| JP | 2011-033706 | 2/2011 |

OTHER PUBLICATIONS

European Patent Application No. 13 761 842.7—Search Report issued on Jan. 14, 2015.
International Search Report dated Apr. 2, 2013.

* cited by examiner

CONTAINER AND IMAGE FORMING APPARATUS

TECHNICAL FIELD

The present invention relates to a container for supplying developer to a developing device, which develops an electrostatic latent image, and an image forming apparatus which uses developer to form an image.

BACKGROUND ART

An image forming apparatus such as a printer and a copier includes a developing device, which uses developer to develop electrostatic latent images, a container for supplying developer to the developing device, and a main housing, in which the developing device and the container are stored. While the image forming apparatus forms images, an amount of the developer remaining in the container is not visually recognized because the container is stored in the main housing. Accordingly, the amount of the developer remaining in the container is typically detected by a magnetic permeability sensor JP 2008-52015 A.

A container disclosed in JP 2008-52015 A includes a magnetic permeability sensor, and a cleaning member, which cleans developer adhered to the magnetic permeability sensor. The magnetic permeability sensor may detect not only an amount of developer remaining in the container but also an amount of developer adhered to the cleaning member. Therefore, the container of JP 2008-52015 A may detect the amount of the developer remaining in the container with little influence of the developer adhered to the cleaning member.

While the image forming apparatus forms images, a condition of the developer in the container always changes. Therefore, the conditional change of the developer in the container may result in unstable determination of an amount of the developer remaining in the container. The techniques disclosed in JP 2008-52015 A do not contribute to identifying a state of the entire developer in the container although the techniques of JP 2008-52015 A may identify a state of the developer on the cleaning member.

SUMMARY OF INVENTION

The present invention has an object of providing a container and an image forming apparatus including a structure which allows appropriate detection of an amount of developer remaining in the container in response to a state of the developer in the container.

A container according to one embodiment of the present invention supplies developer to a developing device which develops an electrostatic latent image. The container includes: a housing having a primary portion for storing the developer, and a secondary portion, which projects from the primary portion and is connected to the developing device; a conveying mechanism which conveys the developer in the primary portion to the secondary portion; and a detector which detects a state of the developer. The primary portion includes a facing wall which is situated at a boundary between the primary and secondary portions so that the facing wall faces a flow of the developer moving toward the secondary portion. The developer includes a flowing portion conveyed to the secondary portion by the conveying mechanism, and an adhering portion forming an adhering layer made of the developer adhered to the facing wall. The detector detects a decrease of the flowing portion and a decrease of the adhering portion individually.

According to the aforementioned configuration, the container supplies developer to the developing device. The developing device develops an electrostatic latent image to form an image. Therefore, the developer in the container is gradually consumed.

The facing wall at a boundary between the primary portion, in which the developer is stored, and the secondary portion projecting from the primary portion faces a flow of the developer conveyed to the secondary portion by the conveying mechanism. Consequently, the developer includes a flowing portion conveyed to the secondary portion by the conveying mechanism and an adhering portion forming an adhering layer made of the developer adhered to the facing wall. Since the detector detects a decrease of the flowing portion and a decrease of the adhering portion individually, a remaining amount of the developer is appropriately detected on the basis of a state of the developer in the container.

An image forming apparatus according to another embodiment of the present invention includes a developing device, which develops an electrostatic latent image to form an image, and a container for supplying developer to the developing device. The container includes: a housing including a primary portion for storing the developer, and a secondary portion, which projects from the primary portion and is connected to the developing device; a conveying mechanism which conveys the developer in the primary portion to the secondary portion; and a detector which detects a state of the developer. The primary portion includes a facing wall which is situated at a boundary between the primary and secondary portions so that the facing wall faces a flow of the developer moving toward the secondary portion. The developer includes a flowing portion conveyed to the secondary portion by the conveying mechanism, and an adhering portion forming an adhering layer made of the developer adhered to the facing wall. The detector detects a decrease of the flowing portion and a decrease of the adhering portion individually.

According to the aforementioned configuration, the container supplies developer to the developing device. The developing device develops an electrostatic latent image to form an image. Therefore, the developer in the container is gradually consumed.

The primary portion of the container stores the developer. The secondary portion projecting from the primary portion is connected to the developing device. The conveying mechanism conveys the developer in the primary portion to the secondary portion. The detector detects a state of the developer.

The facing wall at a boundary between the primary portion, in which the developer is stored, and the secondary portion projecting from the primary portion faces a flow of the developer conveyed to the secondary portion by the conveying mechanism. Consequently, the developer includes a flowing portion conveyed to the secondary portion by the conveying mechanism and an adhering portion forming an adhering layer made of the developer adhered to the facing wall. Since the detector detects a decrease of the flowing portion and a decrease of the adhering portion individually, a remaining amount of the developer is appropriately detected in response to the state of the developer in the container.

The aforementioned container and image forming apparatus may appropriately detect a remaining amount of the developer on the basis of a state of the developer in the container.

These and other objects, features and advantages of the present invention will become more apparent upon reading the following detailed description along with the accompanying drawings.

DESCRIPTION OF EMBODIMENTS

A container and an image forming apparatus are described with reference to the accompanying drawings. Directional terms such as "up", "down", "left" and "right" are simply used for clarifying the description. Therefore, these terms are not intended to limit principles of the container and the image forming apparatus.

(Image Forming Apparatus)

Figure 1:
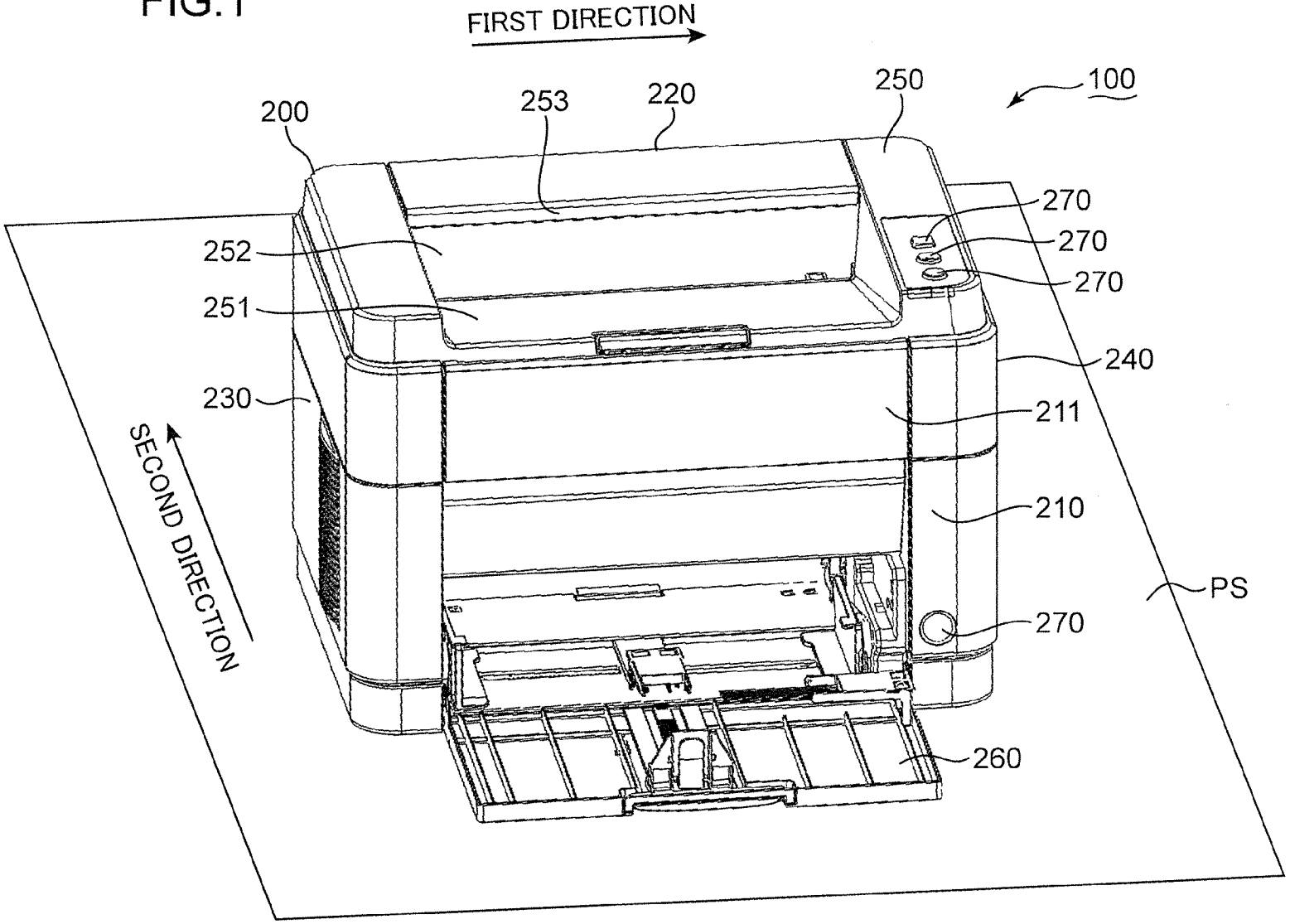
FIG. 1 is a schematic perspective view of a printer exemplified as the image forming apparatus.

FIG. 1 is a schematic perspective view of a printer 100 exemplified as the image forming apparatus. The printer 100 is described with reference to FIG. 1. Alternatively, a copier or other apparatuses configured to form images on sheets may be used as the image forming apparatus.

The printer 100 includes a main housing 200 which defines a storage space for storing various devices (e.g. photoreceptor drum, developing device and container) which are used for forming images on sheets. The main housing 200 includes a front wall 210 perpendicular to a placement surface PS, on which the printer 100 is placed, a rear wall 220 opposite to the front wall 210, a left wall 230 situated between the front and rear walls 210, 220, a right wall 240 opposite to the left wall 230, and a top wall 250 surrounded by the upper edges of the front, rear, left and right walls 210, 220, 230, 240. In the following description, the direction from the left wall 230 to the right wall 240 is referred to as "first direction" whereas the direction from the front wall 210 to the rear wall 220 is referred to as "second direction". The first and second directions are orthogonal. The term "orthogonal" does not refer only to crossing at an angle of 90 degrees. The term "orthogonal" also means intersection at an angle close to 90 degrees, as far as the principles of the present embodiment is implemented. The front and rear walls 210, 220 are arranged along the first direction (i.e. the front and rear walls 210, 220 are arranged substantially in parallel to the first direction). The left and right walls 230, 240 are arranged along the second direction (i.e. the left and right walls 230, 240 are arranged substantially in parallel to the second direction).

The printer 100 further includes a sheet tray 260 for placing or storing sheets. The sheets set on the sheet tray 260 are fed into the main housing 200 and then subjected to image formation processes. The sheet tray 260 is rotatably attached to the front wall 210. A user may pull down the sheet tray 260 forward to set sheets on the sheet tray 260.

The top wall 250 of the main housing 200 includes an inclined wall 251, which defines a concavity for stacking sheets after the image formation processes, and a discharge wall 252, which is upright from the inclined wall 251. The discharge wall 252 is formed with a discharge port 253 for discharging sheets. The sheets discharged from the discharge port 253 are stacked on the inclined wall 251.

The printer 100 includes operation buttons 270 which are situated on the front wall 210 and the top wall 250 near the front wall 210. A user may face the front wall 210 and easily operate the printer 100. Since sheets are discharged from discharge port 253 to the user in front of the front wall 210, the user may easily observe the discharge of the sheets. Since the sheet tray 260 is attached to the front wall 210 as described above, the user in front of the front wall 210 may also observe an amount of sheets on the sheet tray 260 simultaneously. Therefore, the user may easily operate the printer 100 or observe operation of the printer 100 if the user faces the front wall 210.

The front wall 210 includes a cover plate 211 detachable from the main housing 200. A user may detach the cover plate 211 forming an upper part of the front wall 210 and access various devices situated in the main housing 200.

Figure 2:
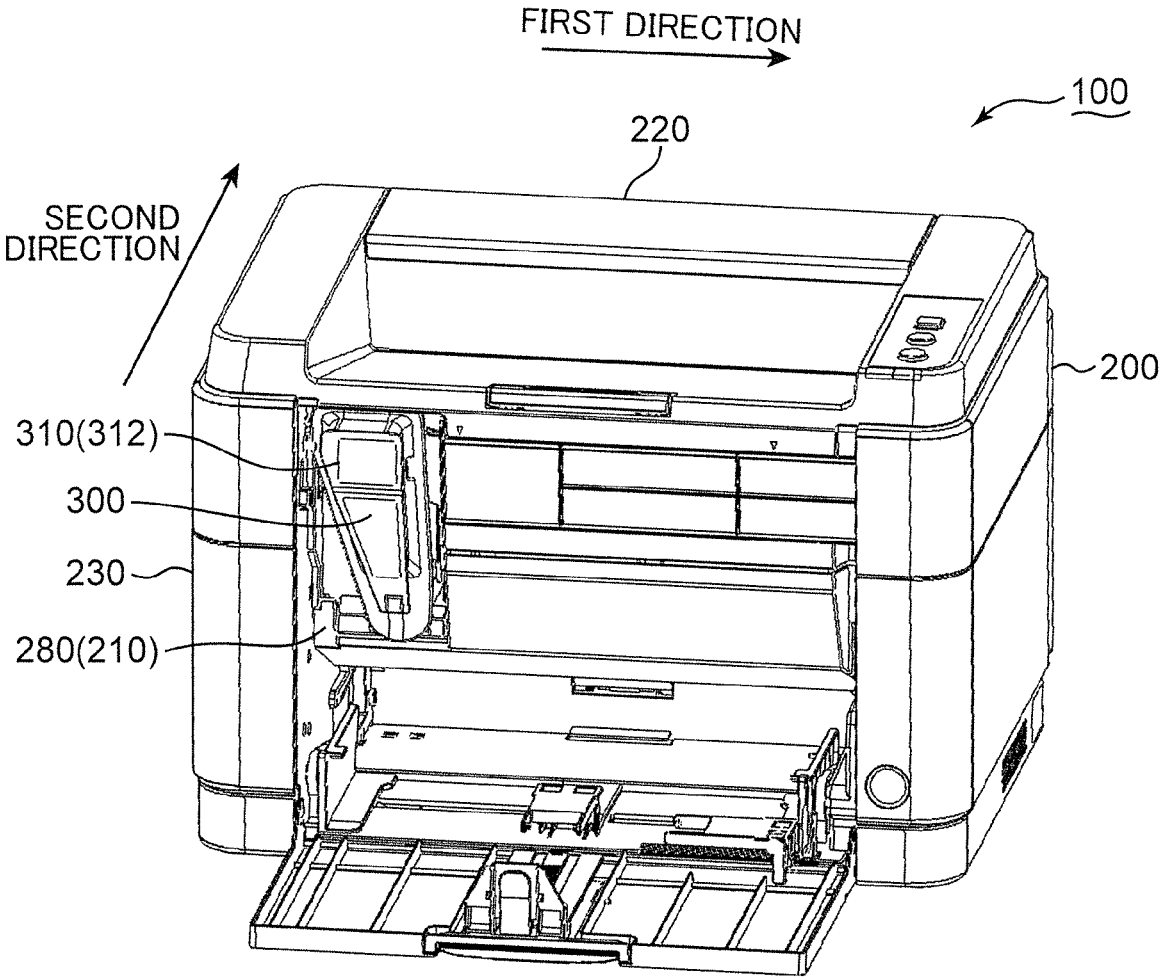
FIG. 2 is a schematic perspective view of the printer from which a cover plate is detached.
Figure 3:
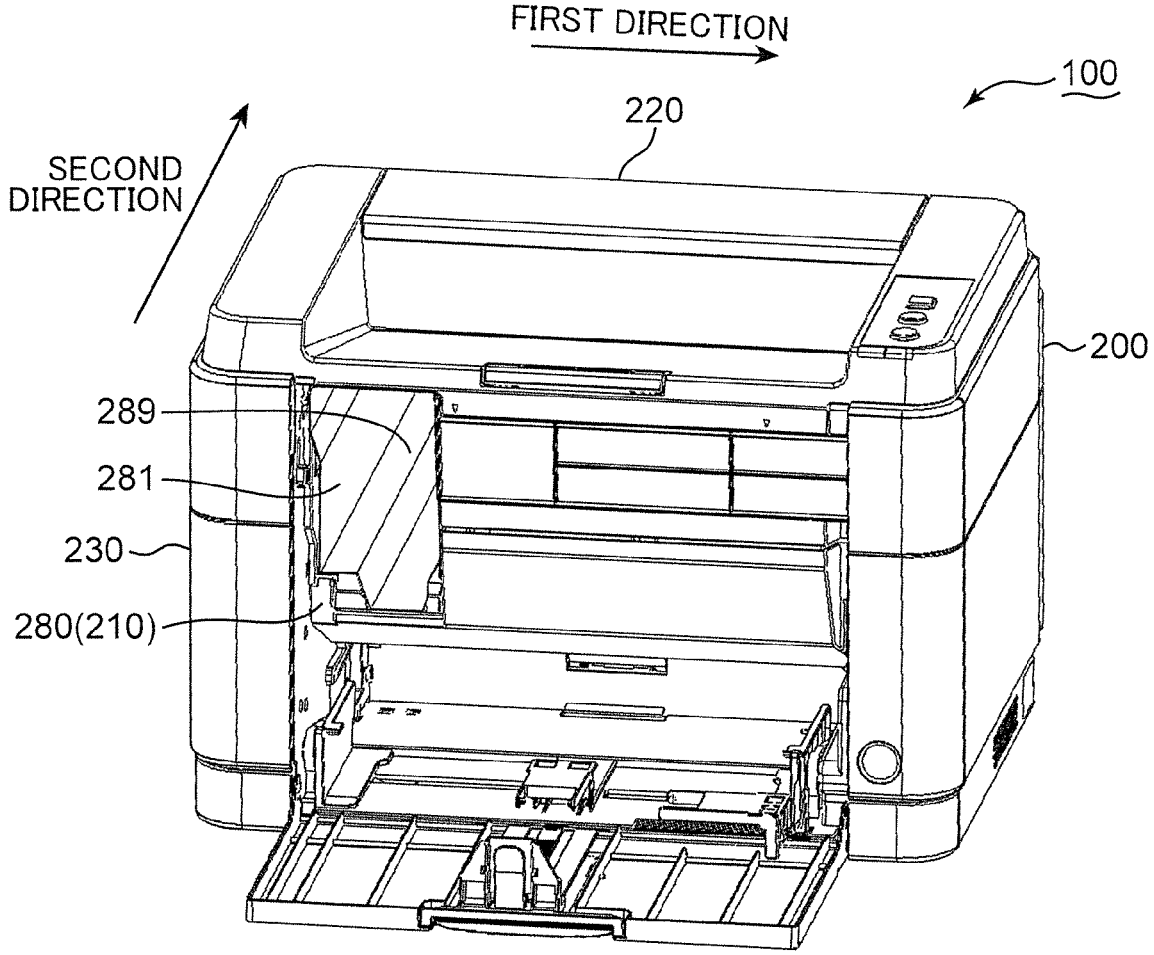
FIG. 3 is a schematic perspective view of the printer from which the cover plate is detached.

FIGS. 2 and 3 are schematic perspective views of the printer 100 from which the cover plate 211 is detached. The printer 100 is further described with reference to FIGS. 1 to 3.

As shown in FIG. 2, the printer 100 further includes a container 300 for storing developer, and an internal frame 280 for supporting the container 300 and other devices used for forming images. The container 300 stores developer. The developer in the container 300 is supplied to a developing device (described later) to develop electrostatic latent images to form images. A part of the internal frame 280 next to the cover plate 211 forms a part of the front wall 210.

A user may detach the cover plate 211 from the main housing 200 to expose the container 300. The user may pull out the container 300 from the main housing 200 easily when the container 300 contains an insufficient amount of developer.

As shown in FIG. 3, the internal frame 280 is formed with an insertion port 281 for inserting the container 300 into the main housing 200. A cavity extending in the second direction from the insertion port 281 inside the main housing 200 is used as an insertion path 289 for the container 300. A user may push the container 300 containing a sufficient amount of developer along the left wall 230 through the insertion port 281 into the insertion path 289 defined by the main housing 200. When the container 300 is pushed into the insertion path 289 completely, the container 300 is connected to the developing device (described later).

Figure 4:
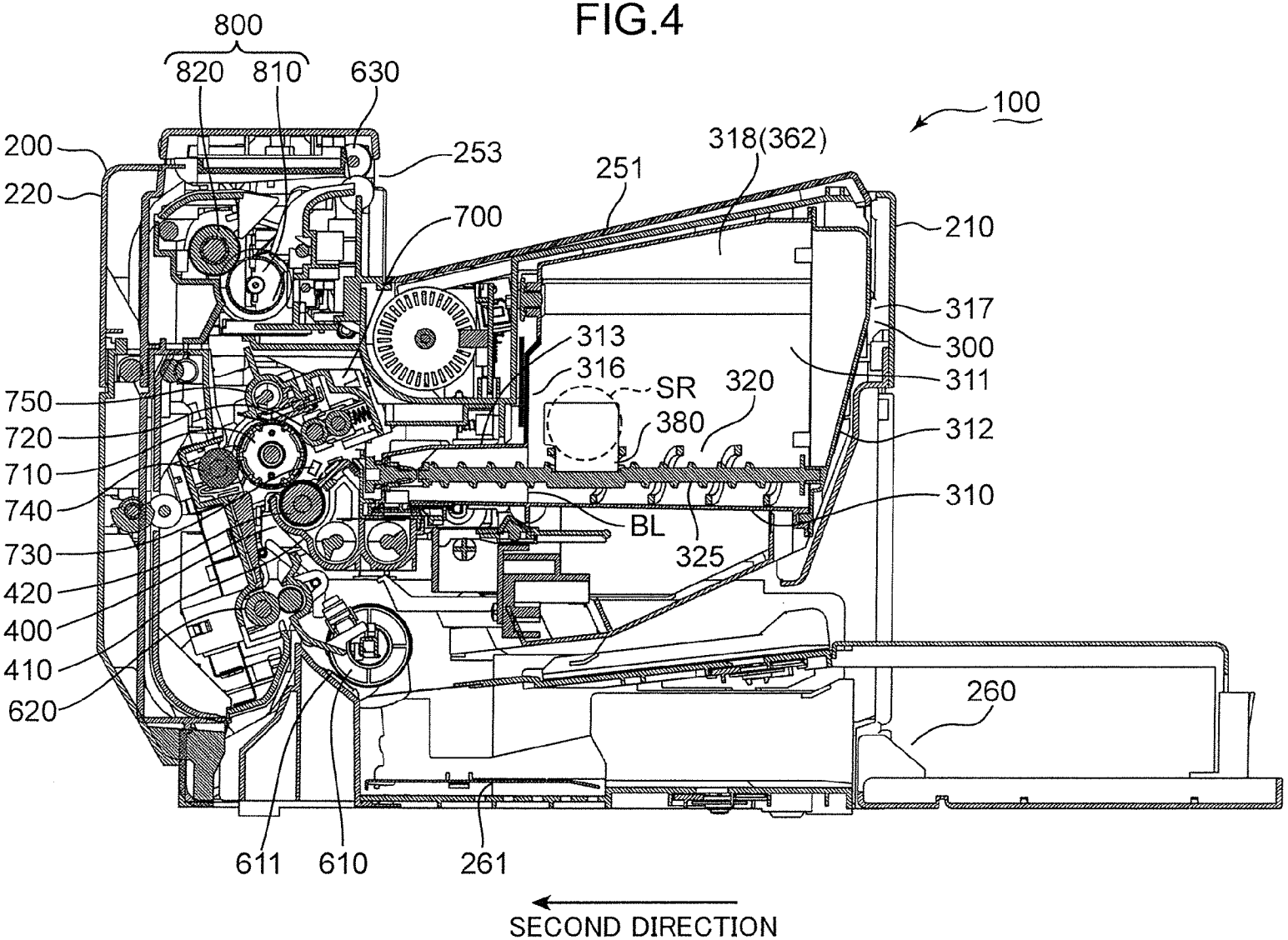
FIG. 4 is a schematic cross-sectional view of the printer shown in FIG. 1.

FIG. 4 is a schematic cross-sectional view of the printer 100. The printer 100 is further described with reference to FIG. 4.

The sheet tray 260 includes a lift plate 261 for lifting leading edges of sheets. The printer 100 further includes a feed roller 610 situated above the lift plate 261, and a friction plate 611 next to the feed roller 610. A leading edge of a sheet lifted by the lift plate 261 comes into contact with the feed roller 610. The feed roller 610 rotates to convey the sheet downstream. Sheets pass through between the friction plate 611 and the feed roller 610 one by one. The sheet tray 260 and the feeding structure for feeding sheets from the sheet tray 260 do not limit the principles of the present embodiment.

The printer 100 further includes a registration roller pair 620 situated at a downstream of the feed roller 610, and an image former 700 which forms images on sheets. The feed roller 610 feeds a sheet to the registration roller pair 620. The registration roller pair 620 feeds the sheet to the image former 700 at a suitable timing for the image formation process performed by the image former 700. Consequently, an image is formed at an appropriate position on the sheet.

The image former 700 includes a photoreceptor drum 710 having a circumferential surface, on which an electrostatic latent image is formed, a charger 720, which charges the circumferential surface of the photoreceptor drum 710 substantially uniformly, and an exposing device 730, which irradiates the charged circumferential surface of the photoreceptor drum 710 with laser light. When the photoreceptor drum 710 rotates, the circumferential surface of the photoreceptor drum 710 charged by the charger 720 moves to an exposing position and is subjected to an exposing process by the exposing device 730. The printer 100 is electrically connected to an external device (e.g. personal computer (not shown)) which outputs image signals. The exposing device 730 irradiates the circumferential surface of the photoreceptor drum 710 with laser light in response to the image signals from the external device. Consequently, the circumferential surface of the photoreceptor drum. 710 is formed with an electrostatic latent image coincident with an image defined by the image signals.

In addition to the aforementioned container 300, the image former 700 includes a developing device 400 which supplies developer to an electrostatic latent image formed on the circumferential surface of the photoreceptor drum 710. The circumferential surface of the photoreceptor drum 710 carrying an electrostatic latent image moves to a developing position at which the electrostatic latent image is developed. As a result of the developer supply from the developing device 400, the electrostatic latent image is developed (visualized) so that a toner image is formed on the circumferential surface of the photoreceptor drum 710.

The image former 700 further includes a transfer roller 740 for transferring a toner image formed on the circumferential surface of the photoreceptor drum 710 to a sheet. The circumferential surface of the photoreceptor drum 710 carrying a toner image moves to a transfer position and is subjected to a transfer process by the transferring roller 740. The aforementioned registration roller pair 620 feeds a sheet to a nip between the photoreceptor drum 710 and the transfer roller 740. The transfer roller 740 peels off the toner image from the photoconductor drum 710 electrostatically, and transfers the peeled toner image to a surface of the sheet.

The image former 700 further includes a cleaning device 750 for removing developer from the circumferential surface of the photoreceptor drum 710. The circumferential surface of the photoreceptor drum 710 after transferring a toner image to a sheet moves to a cleaning position and is subjected to a cleaning process by the cleaning device 750. The cleaning device 750 removes developer remaining on the circumferential surface of the photoreceptor drum 710. After that, the circumferential surface of the photoreceptor drum 710 arrives at a charging position and is subjected to a charging process by the charger 720. Subsequently, another image formation process starts. The aforementioned image formation process as well as the structures and arrangements of various devices used for the image formation process do not limit the principle of the present embodiment.

The printer 100 further includes a fixing device 800 which fixes toner images on sheets. The fixing device 800 includes a heating roller 810 for melting toner of a toner image transferred on a sheet, and a pressure roller 820 which presses the toner image against the heating roller. The photoreceptor drum 710 and the transfer roller 740 feed a sheet to a nip between the heating roller 810 and the pressure roller 820. Toner of a toner image carried by the sheet is melted and fixed on the sheet by the heating roller 810. The structure of the fixing device does not limit the principle of the present embodiment.

The printer 100 further includes a discharge roller pair 630 situated near the discharge port 253 formed in the main housing 200. The heating roller 810 and the pressure roller 820 feed a sheet to the discharge roller pair 630. The discharge roller pair 630 discharges the sheet onto the inclined wall 251 through the discharge port 253.

(Developing Device)

Figure 5:
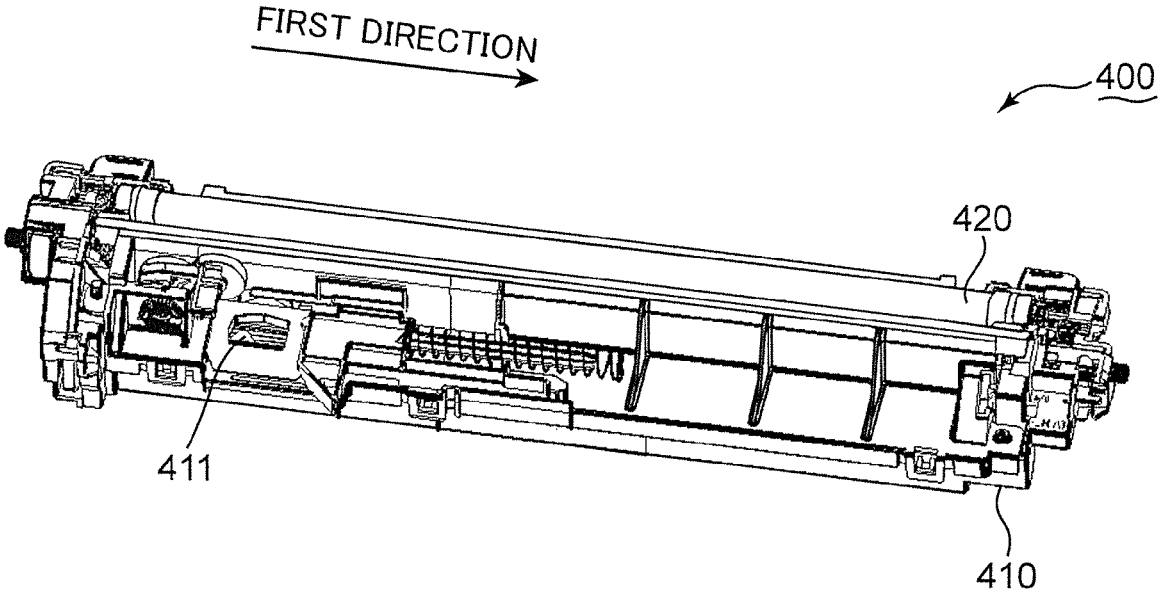
FIG. 5 is a schematic perspective view of a developing device included in the printer shown in FIG. 4.

FIG. 5 is a schematic perspective view of the developing device 400. The developing device 400 is described with reference to FIGS. 2, 4 and 5.

The developing device 400 includes a first housing 410 extending in the first direction (i.e. in the width direction of a sheet), and a developing roller 420 supported by the first housing 410. The first housing 410 has a left end formed with a replenishment port 411.

As shown in FIG. 2, the container 300 is adjacent to the left wall 230. The container 300 pushed along the left wall 230 is connected to the left end of the first housing 410. Developer stored in the container 300 is supplied into the first housing 410 through the replenishment port 411.

As shown in FIG. 4, the developing roller 420 is adjacent to the photoreceptor drum 710. The developing roller 420 carries developer stored in the first housing 410 to supply the developer to an electrostatic latent image formed on the circumferential surface of the photoreceptor drum 710.

Figure 6:
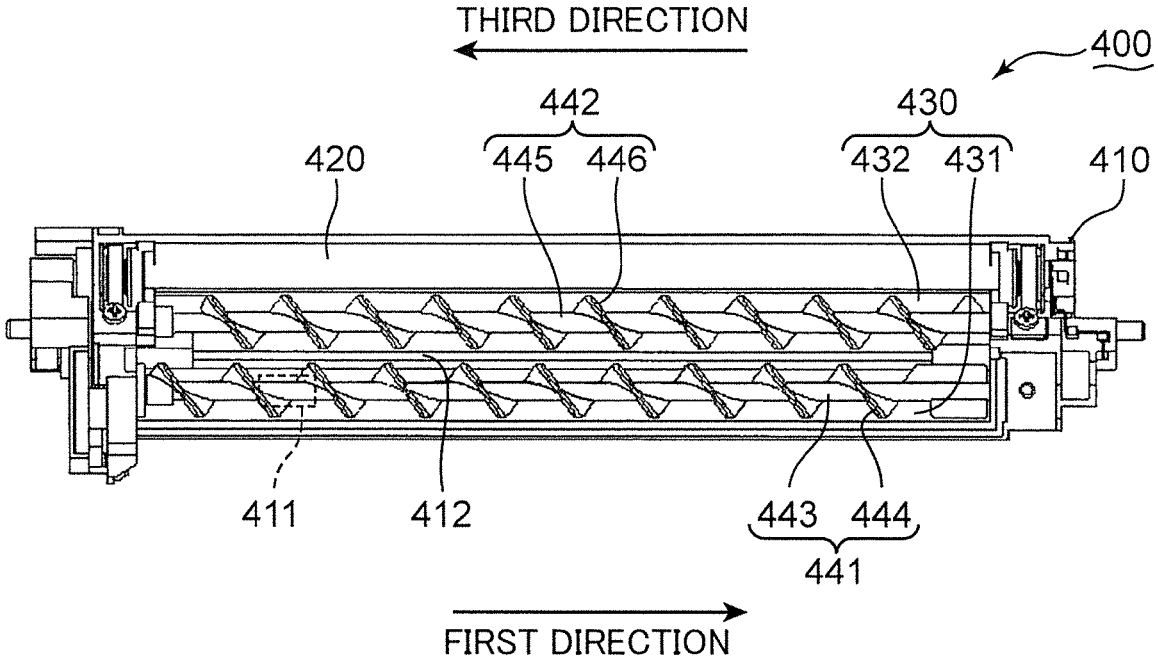
FIG. 6 is a schematic view of an internal structure of the developing device shown in FIG. 5.

FIG. 6 is a schematic view of an internal structure of the developing device 400. The developing device 400 is further described with reference to FIG. 6.

The first housing 410 of the developing device 400 includes a partition wall 412 which partitions a storage space 430 for storing developer into a first space 431 and a second space 432. FIG. 6 shows the aforementioned replenishment port 411 by the dashed line. The replenishment port 411 directly communicates with the first space 431. The first space 431 communicates with the second space 432 at the right end of the first housing 410. Developer supplied to the first space 431 through the replenishment port 411 is introduced into the second space 432 at the right end of the first housing 410.

The developing device 400 further includes a first conveying screw 441 situated in the first space 431, and a second conveying screw 442 situated in the second space 432. The first conveying screw 441 includes a shaft 443 extending in the first direction, and a screw member 444 winding around the shaft 443. The second conveying screw 442 includes a shaft 445 substantially parallel to the shaft 443, and a screw member 446 winding around the shaft 445.

When the first conveying screw 441 rotates, developer supplied to the first space 431 is conveyed in the first direction away from the replenishment port 411. Consequently, the developer reaches the right end of the first housing 410, and then is introduced into the second space 432.

When the second conveying screw 442 rotates, the developer introduced in the second space 432 is conveyed in the third direction opposite to the first direction. The developer conveyed by the first and second conveying screws 441, 442 includes toner particles and carrier particles. The first and second conveying screws 441, 442 stir these particles during the conveyance. Consequently, the toner particles are charged, and electrostatically adhered on the developing roller 420 during the conveyance by the second conveying screw 442. Consequently, the developing roller 420 carries the toner particles substantially uniformly.

(Container)

Figure 7:
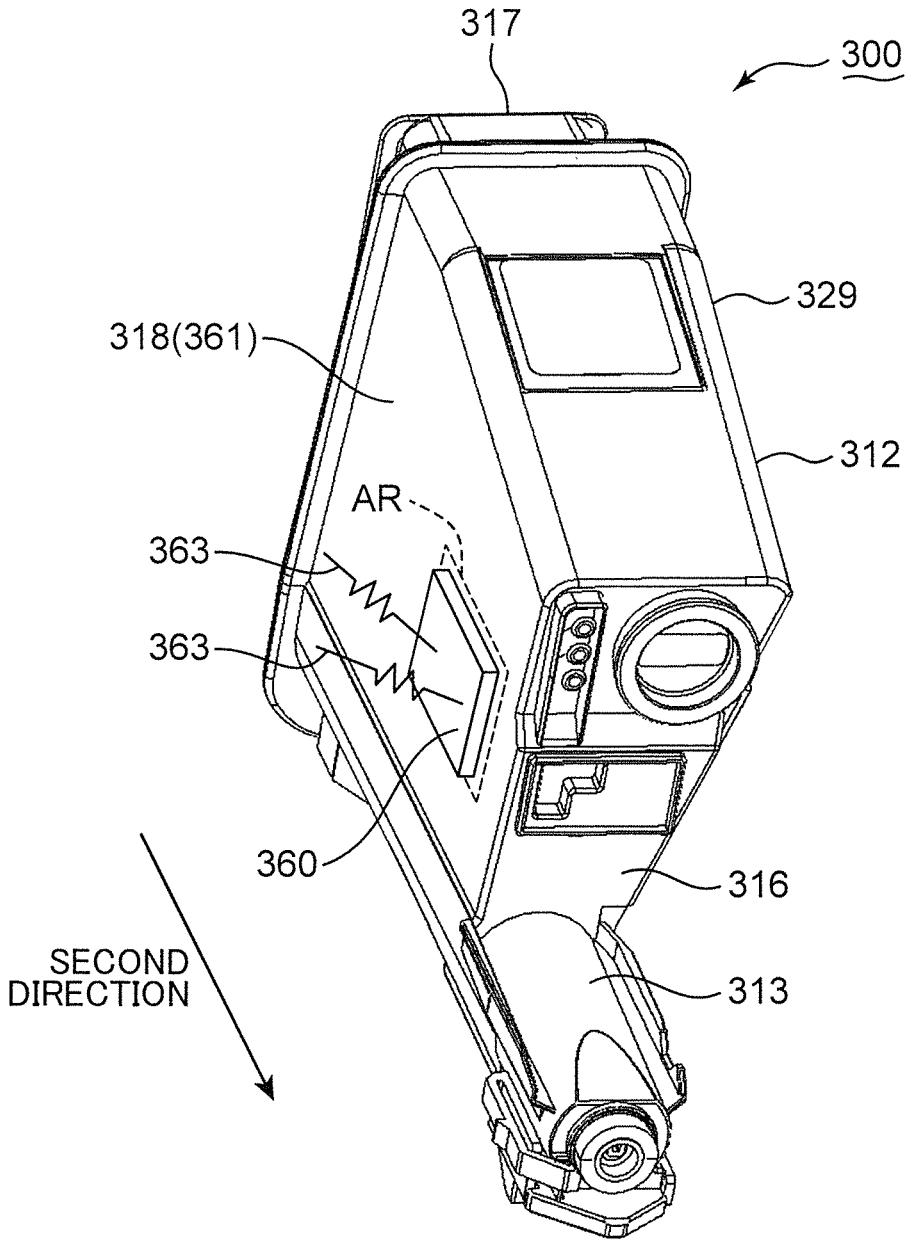
FIG. 7 is a schematic perspective view of a container of the printer shown in FIG. 4.

FIG. 7 is a schematic perspective view of the container 300. The container 300 is described with reference to FIGS. 4 and 7.

The container 300 includes a second housing 310 which defines a storage space 311 for storing developer. The second housing 310 includes a primary storage portion 312 having a relatively large volume, and a substantially cylindrical projecting cylinder 313 projecting from a lower portion of the primary storage portion 312 in the second direction. A large part of developer is stored in the primary storage portion 312. As shown in FIG. 4, the projecting cylinder 313 is connected to the developing device 400. In the present embodiment, the second housing 310 is exemplified as the housing. The primary storage portion 312 is exemplified as the primary portion. The projecting cylinder 313 is exemplified as the secondary portion.

The container 300 further includes a screw feeder 320 for conveying developer in the second housing 310. The screw feeder 320 conveys developer from the primary storage portion 312 to the projecting cylinder 313. In the present embodiment, the screw feeder 320 is exemplified as the conveying mechanism.

The primary storage portion 312 includes a facing wall 316, which is situated so that the facing wall 316 faces developer moving from the primary storage portion 312 to the projecting cylinder 313 due to the screw feeder 320. The facing wall 316 stands on a boundary BL between the primary storage portion 312 and the projecting cylinder 313. Since developer is moved by the screw feeder 320 from the primary storage portion 312 to the projecting cylinder 313, a part of the developer stored in the container 300 is pressed against the facing wall 316. The part of the developer pressed against the facing wall 316 becomes a layer adhered to the facing wall 316 after most of developer in the primary storage portion 312 is supplied to the developing device 400. In the following description, the layer of the developer adhered to the facing wall 316 is referred to as "adhering layer". The part of the developer forming the adhering layer is exemplified as the adhering portion. The developer conveyed to the projecting cylinder 313 by the screw feeder 320 is exemplified as the flowing portion.

The primary storage portion 312 further includes a first end wall 317 opposite to the facing wall 316, a right wall 318, which stands between the facing wall 316 and the first end wall 317, and a left wall 329 opposite to the right wall 318. The container 300 further includes a magnetic permeability sensor 360. The right wall 318 includes an outer surface 361, to which the magnetic permeability sensor 360 is attached, and an inner surface 362 opposite to the outer surface 361. FIG. 4 shows the inner surface 362. FIG. 7 shows the outer surface 361.

Developer in the container 300 has magnetism. The magnetism changes in response to an amount of the developer in the container 300. The magnetic permeability sensor 360 outputs data corresponding to a change in the magnetism. The data output by the magnetic permeability sensor 360 reflects a state of the developer in the container 300 as described later. In the present embodiment, the magnetism is exemplified as the physical property of the developer which changes in response to an amount of the developer. The magnetic permeability sensor 360 is exemplified as the detector. The detector may detect other physical characteristics which change in response to an amount of the developer in the container.

In the present embodiment, the magnetic permeability sensor 360 is attached to the right wall 318. Therefore, the right wall 318 is exemplified as the side wall. Alternatively, the magnetic permeability sensor 360 may be attached to the left wall 329.

As shown in FIG. 7, the outer surface 361 includes an attachment region AR to which the magnetic permeability sensor 360 is attached. The container 300 further includes a coil spring 363 which presses the magnetic permeability sensor 360 against the attachment region AR. Since the magnetic permeability sensor 360 is attached to the attachment region AR by pressure, a change in the magnetic permeability of the developer in the container 300 may be detected appropriately. In the present embodiment, the outer surface 361 and the attachment region AR are exemplified as the attachment surface. The coil spring 363 is exemplified as the pressing mechanism. Alternatively, the pressing mechanism may be other mechanisms, structures and/or elements configured to press the magnetic permeability sensor 360 against the attachment region AR.

As shown in FIG. 4, the inner surface 362 includes a detection region SR opposite to the attachment region AR. The detection region SR is situated above the screw feeder 320. While the detection region SR is covered by developer, the magnetic permeability sensor 360 detects high magnetic permeability. As the screw feeder 320 conveys the developer in the primary storage portion 312, the top surface of the developer layer in the primary storage portion 312 moves down. Consequently, the detection region SR is gradually exposed from the developer. As the detection region SR is further exposed, the magnetic permeability sensor 360 detects lower magnetic permeability.

As described above, a part of the developer conveyed to the projecting cylinder 313 by the screw feeder 320 is pressed against the facing wall 316 standing above the screw feeder 320 and becomes the adhering layer. As the top surface of the developer layer in the primary storage portion 312 moves down, the part of the developer adhered to the facing wall 316 appears as the adhering layer.

As shown in FIG. 4, the detection region SR is adjacent to the facing wall 316. Therefore, the magnetic permeability sensor may detect magnetic permeability of the part of the developer adhered to the facing wall 316 even after the detection region SR is exposed. Since the developer below the adhering layer then disappears when the developer below the facing wall 316 is sent to the developing device 400 by the screw feeder 320, the adhering layer collapses. Consequently, the magnetic permeability sensor 360 detects a decrease in magnetic permeability. Therefore, the magnetic permeability sensor 360 may individually detect a decrease in an amount of the developer conveyed without being adhered to the facing wall 316, and a decrease in an amount of the developer which is sent to the developing device 400 after being adhered to the facing wall 316. The detection of the magnetic permeability performed by the magnetic permeability sensor 360 is further described later.

(Screw Feeder)

Figure 8:
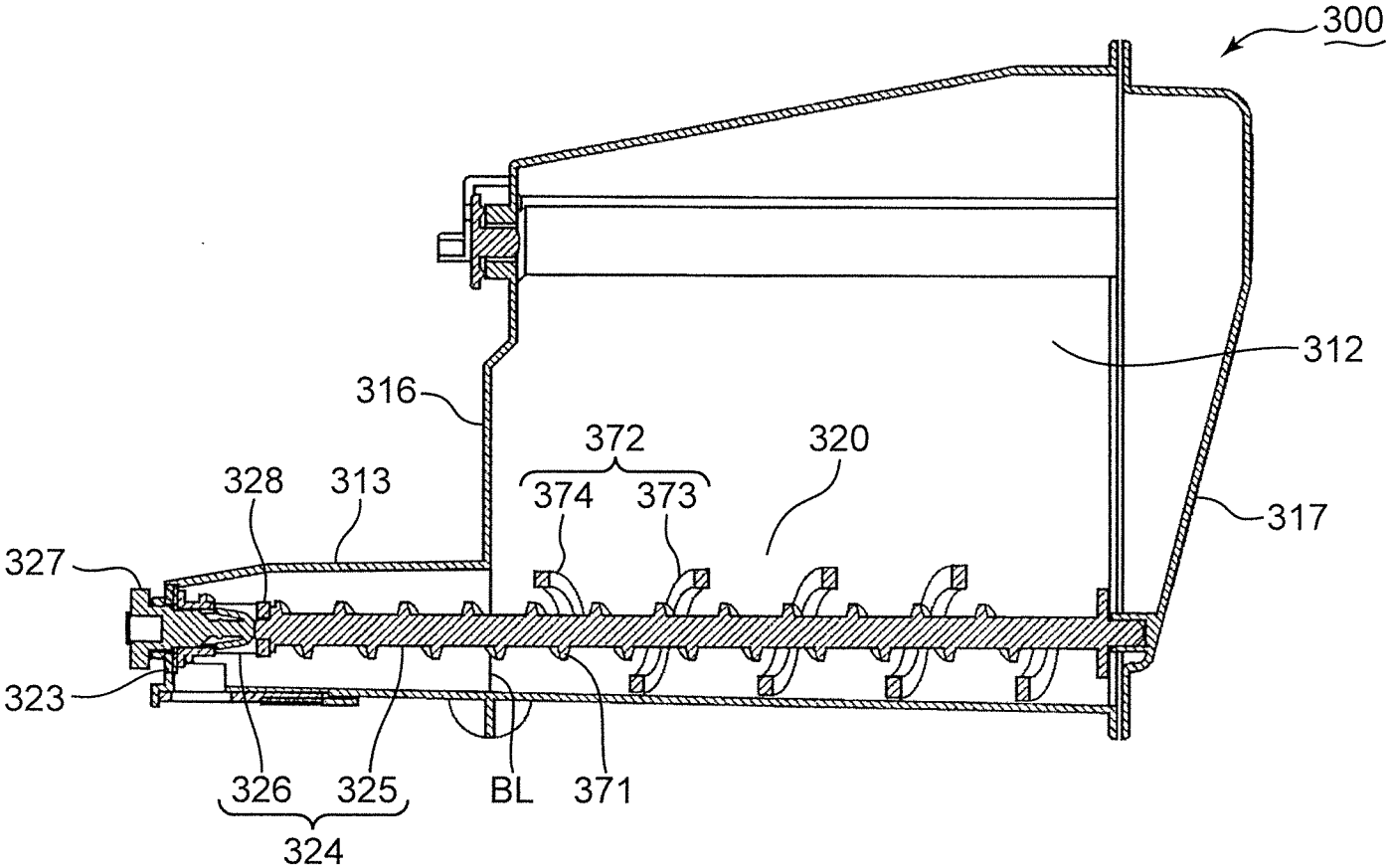
FIG. 8 is a schematic cross-sectional view of the container shown in FIG. 7.

FIG. 8 is a schematic cross-sectional view of the container 300. The screw feeder 320 is described with reference to FIG. 8.

The projecting cylinder 313 includes a second end wall 323 opposite to the first end wall 317. The screw feeder 320 includes a rotary shaft 324 extending from the first end wall 317 to the second end wall 323. The rotary shaft 324 includes a shaft portion 325 extending from the primary storage portion 312 to the projecting cylinder 313, and a holding gear 326 inserted into the projecting cylinder 313 through a through-hole formed in the second end wall 323. The shaft portion 325 has one end held by the first end wall 317 and the other end held by the holding gear 326.

The holding gear 326 includes a gear portion 327 appearing outside the container 300, and a connecting piece 328 connected to the shaft portion 325 in the container 300. The gear portion 327 is connected to a driving source (not shown) such as a motor. Torque transferred from the driving source to the gear portion 327 is transmitted to the shaft portion 325 via the connecting piece 328. Consequently, the shaft portion 325 rotates in the container 300.

Figure 9:
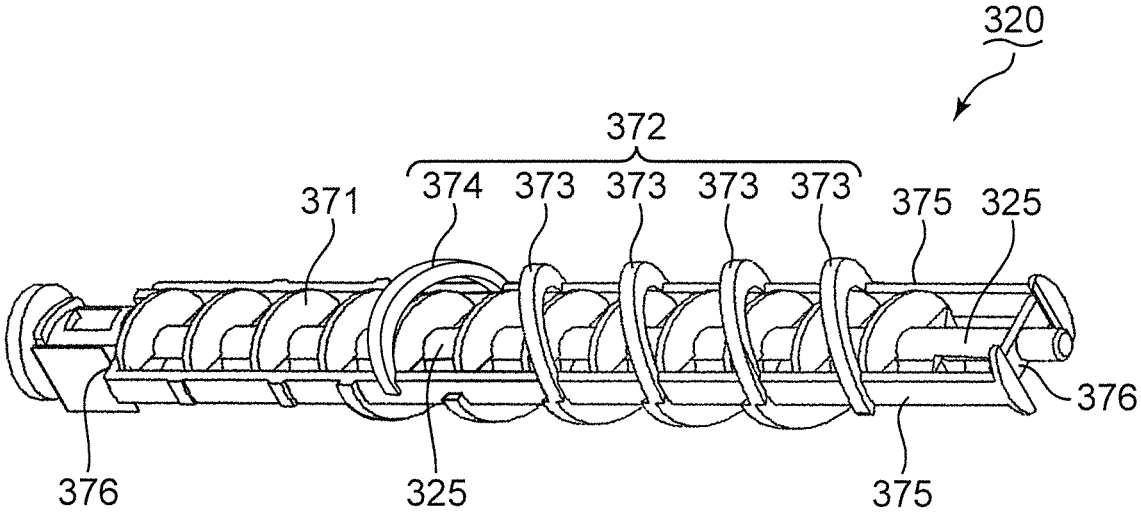
FIG. 9 is a schematic perspective view of a screw feeder of the container shown in FIG. 8.

FIG. 9 is a schematic perspective view of the screw feeder 320. The screw feeder 320 is further described with reference to FIGS. 8 and 9.

The screw feeder 320 further includes a small spiral blade 371 winding around the shaft portion 325, and a large spiral blade 372 winding around the shaft 325 outside the small spiral blade 371. The outer diameter of the large spiral blade 372 is substantially equal to the inner diameter of the projecting cylinder 313. On the other hand, the outer diameter of the small spiral blade 371 is smaller than the inner diameter of the projecting cylinder 313. The screw feeder 320 uses the small and large spiral blades 371, 372 to appropriately convey developer from the primary storage portion 312 to the projecting cylinder 313. In the present embodiment, the screw feeder 320 is exemplified as the conveying screw mechanism.

The small and large spiral blades 371, 372 are tilted from the rotational axis of the shaft portion 325 to cause a flow of developer. The large spiral blade 372 includes first conveyance pieces 373 tilted in a direction different from the small spiral blade 371, and a second conveyance piece 374 tilted in the same direction as the small spiral blade 371.

In the present embodiment, the small spiral blade 371 winds around the shaft portion 325 throughout the primary storage portion 312 and the projecting cylinder 313. On the other hand, the large spiral blade 372 winds around the shaft portion 325 from the boundary BL between the primary storage portion 312 and the projecting cylinder 313 to the first end wall 317. The first conveyance pieces 373 of the large spiral blade 372 are tilted from the shaft portion 325 so that the developer flows from the primary storage portion 312 to the projecting cylinder 313 with rotation of the shaft portion 325. On the other hand, the small spiral blade 371 is tilted from the shaft portion 325 so that the developer flows from the projecting cylinder 313 to the primary storage portion 312 with the rotation of the shaft portion 325. Therefore, the developer is less likely to be compressed into the projecting cylinder excessively. In the present embodiment, the first conveyance pieces 373 of the large spiral blade 372 are exemplified as the first spiral blade. The small spiral blade 371 is exemplified as the second spiral blade. Alternatively, the small spiral blade may send the developer from the primary storage portion to the projecting cylinder whereas the large spiral blade returns the developer from the projecting cylinder to the primary storage portion.

As shown in FIG. 8, the second conveyance piece 374 is situated near the boundary BL between the primary storage portion 312 and the projecting cylinder 313. Since the second conveyance piece 374 is tilted in the same direction as the small spiral blade 371, developer is returned by the second conveyance piece 374 from the projecting cylinder 313 to the primary storage portion 312 in cooperation with the small spiral blade 371. Consequently, the developer flow from the projecting cylinder 313 to the primary storage portion 312 intersects with a developer flow from the primary storage portion 312 to the projecting cylinder 313 around the boundary BL. Accordingly, there may be no excessively hard adhesion of developer to the facing wall 316. Therefore, the layer (adhering layer) of the developer adhered to the facing wall 316 is likely to collapse under absence of developer below the facing wall 316.

As shown in FIG. 9, the screw feeder 320 further includes a pair of holding rods 375 substantially parallel to the shaft portion 325, and a coupling piece 376 for coupling the shaft portion 325 to the paired holding rods 375. The shaft portion 325 is situated between the paired holding rods 375. The first and second conveyance pieces 373, 374 bridge over the shaft portion 325 and are connected to the paired holding rods 375.

The small spiral blade 371 is directly attached to the shaft portion 325. Therefore, the small spiral blade 371 rotates with rotation of the shaft portion 325. The holding rods 375 are coupled to the shaft portion 325 by the coupling piece 376. Therefore, the first and second conveyance pieces 373, 374 also rotate with the rotation of the shaft portion 325.

(Developer Supply)

Figure 10:
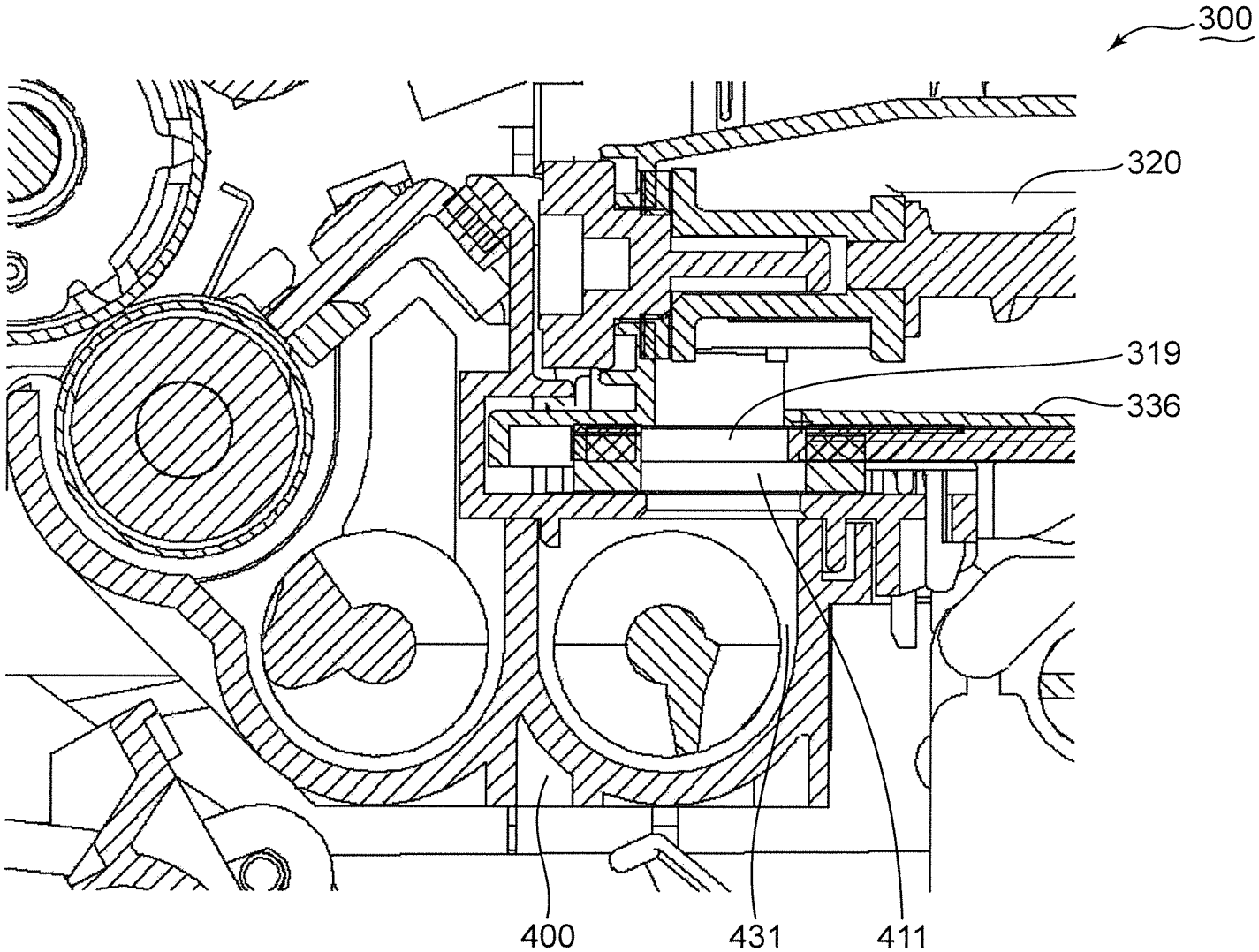
FIG. 10 is a schematic cross-sectional view of the container coupled to the developing device shown in FIG. 4.

FIG. 10 is a schematic cross-sectional view of the container 300 coupled to the developing device 400. Developer supply from the container 300 to the developing device 400 is described with reference to FIGS. 8 and 10.

The container 300 includes a bottom wall 336 extending from the first end wall 317 to the second end wall 323. A part of the bottom wall 336 which is used as a part of the projecting cylinder 313 is connected to the developing device 400. The part of the bottom wall 336 connected to the developing device 400 is formed with a supply port 319 which communicates with the replenishment port 411 of the developing device 400. The supply port 319 and the replenishment port 411 allow the first space 431 of the developing device 400 to communicate with the internal space of the projecting cylinder 313. Therefore, developer sent to the projecting cylinder 313 by the screw feeder 320 falls into the first space 431 through the supply port 319 and the replenishment port 411. In the present embodiment, the portion of the bottom wall 336 connected to the developing device 400 is exemplified as the connector.

(Cleaning of Detection Region)

Cleaning techniques of the detection region SR are described with reference to FIGS. 4 and 7.

As described above, the detection region SR is gradually exposed from developer as the developer is supplied from the container 300 to the developing device 400. However, a part of the developer may be adhered to the detection region SR. Output of the magnetic permeability sensor 360 is largely susceptive to the part of the developer adhered to the detection region SR.

In the present embodiment, the container 300 further includes a cleaning film 380 attached to the shaft portion 325. The cleaning film 380 radially extends from the shaft portion 325 so that a distal edge of the cleaning film 380 comes into contact with the inner surface 362 of the right wall 318. Therefore, the cleaning film 380 rubs the detection region SR with rotation of the shaft portion 325. Accordingly, the part of the developer adhered to the detection region SR is appropriately removed. In the present embodiment, the cleaning film 380 is exemplified as the cleaner.

(Conditional Changes in Developer in Container)

Each of FIGS. 11A to 11E show a state of developer in the container 300. Conditional changes in developer in the container 300 are described with reference to FIGS. 11A to 11E.

Figure 11A:
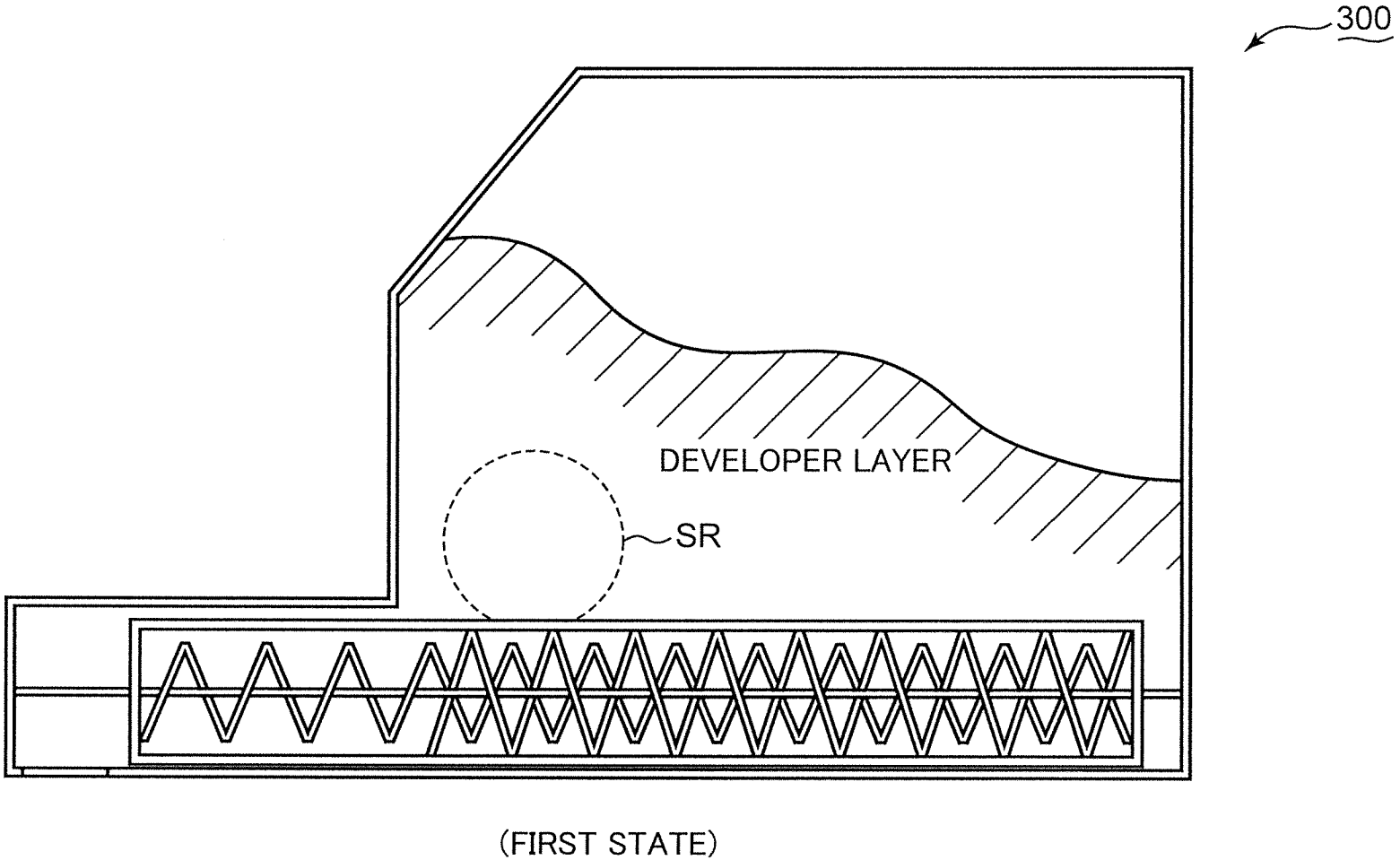
FIG. 11A is a schematic view showing a state of developer in the container shown in FIG. 8.

FIG. 11A shows a state, in which little developer is consumed in the container 300. Therefore, a thick layer of developer is formed in the primary storage portion 312. The detection region SR is entirely covered by the developer layer. During this state, the magnetic permeability sensor 360 outputs a relatively high voltage value. The output voltage from the magnetic permeability sensor 360 is substantially constant. In the following description, the state in which the developer entirely covers the detection region SR is referred to as "first state".

Figure 11B:
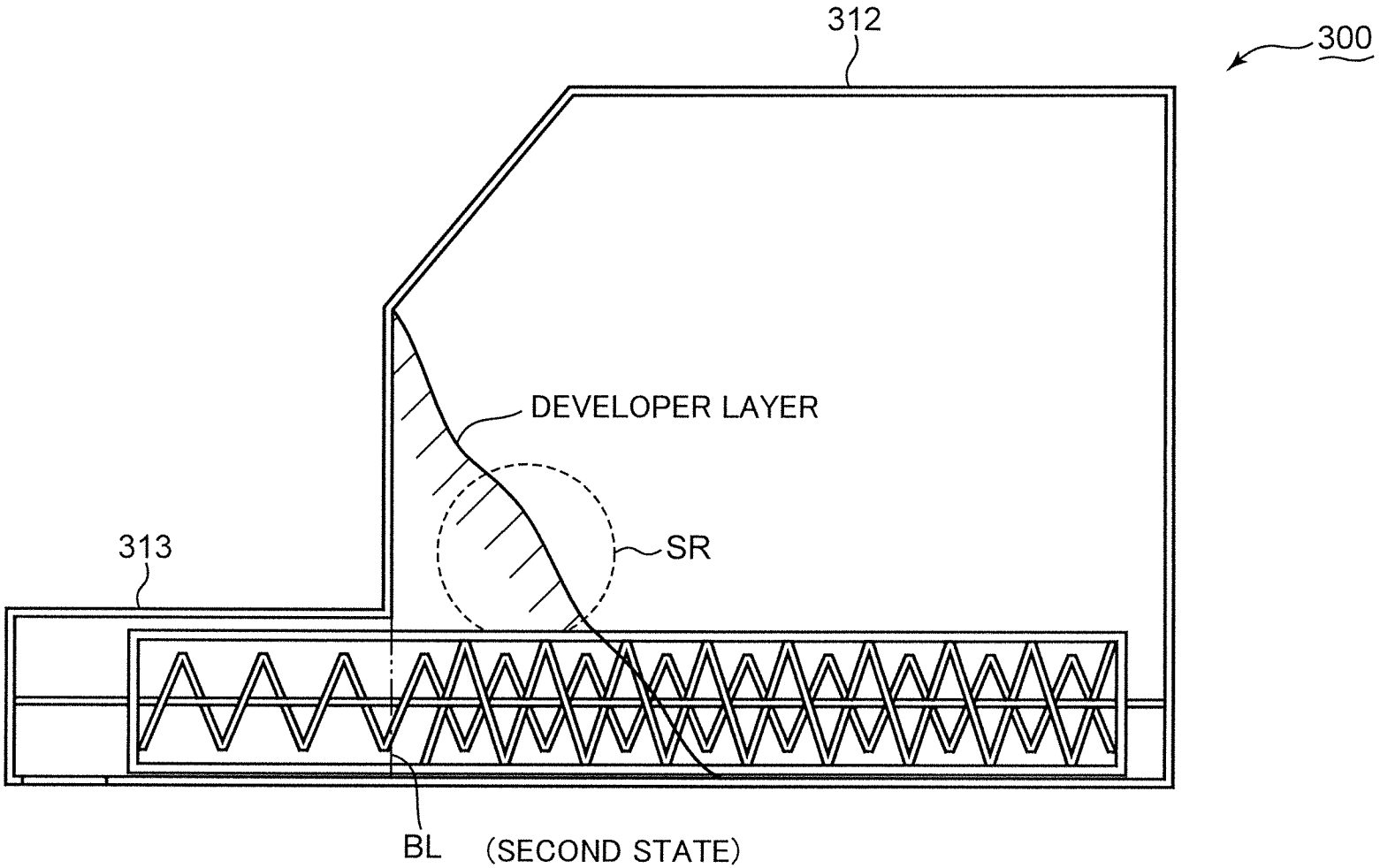
FIG. 11B is a schematic view showing a state of developer in the container shown in FIG. 8.
Figure 11C:
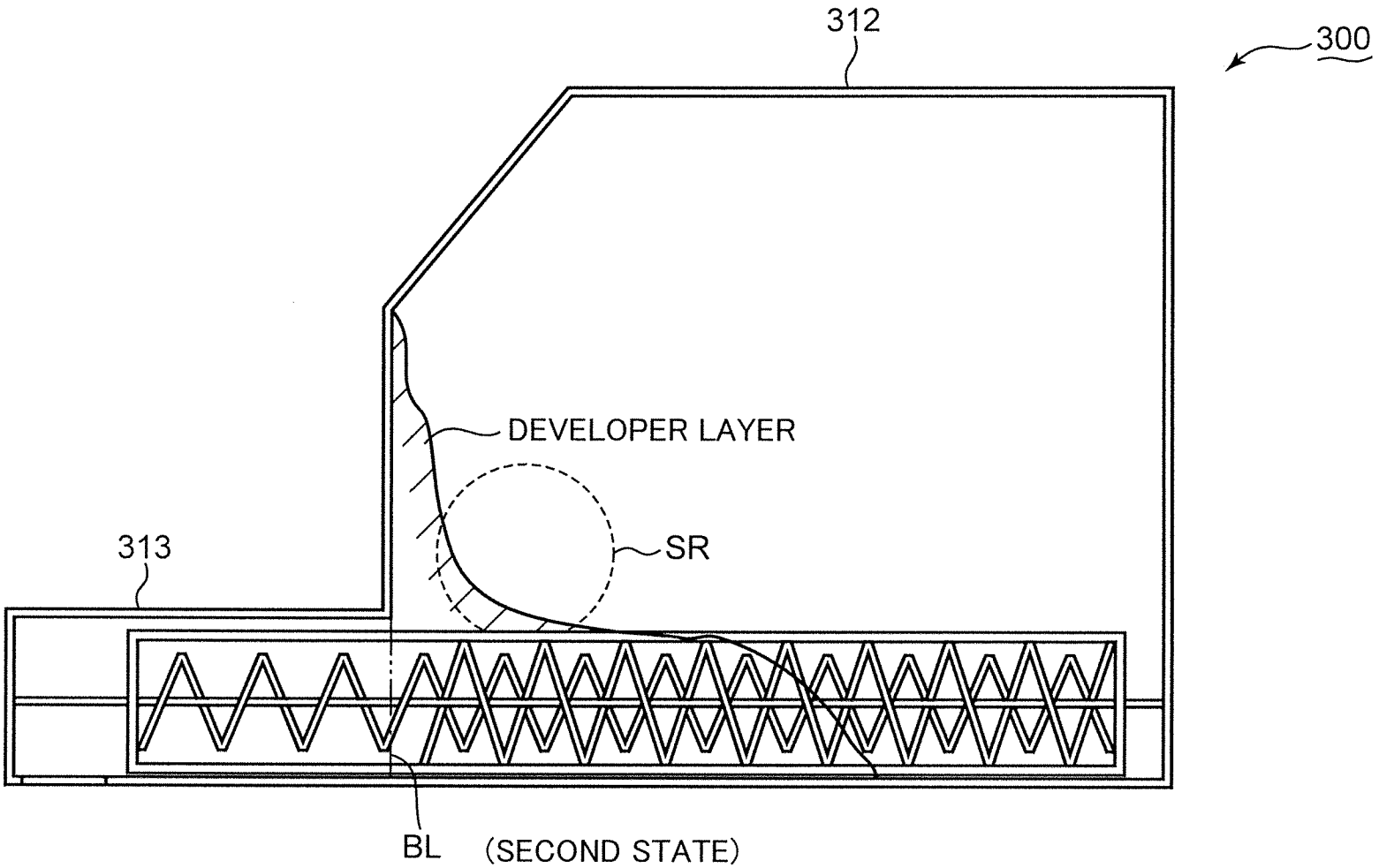
FIG. 11C is a schematic view showing a state of developer in the container shown in FIG. 8.

FIGS. 11B and 11C show the developer in a second state after the first state. Since the developer is introduced into the projecting cylinder 313 through the boundary BL between the primary storage portion 312 and the projecting cylinder 313, there is the developer around the boundary BL and in the projecting cylinder 313 whereas there is no developer in the internal space of the primary storage portion 312 distant from the boundary BL. Consequently, a part of the detection region SR is exposed from the developer layer. The exposed area of the detection region SR increases as the developer is used. A voltage value output from the magnetic permeability sensor 360 gradually decreases since the exposed area of the detection region SR gradually increases during the second state.

The screw feeder 320 causes a complicated flow of the developer around the boundary BL. Therefore, a change in the exposed area of the detection region SR may be unstable. Consequently, the output voltage from the magnetic permeability sensor 360 may not have a constant decreasing rate. The output voltage from the magnetic permeability sensor 360 may show a temporal increase in response to a surface shape of the developer layer while the developer is in the second state although the output voltage from the magnetic permeability sensor 360 shows a decrease tendency as a whole.

Figure 11D:
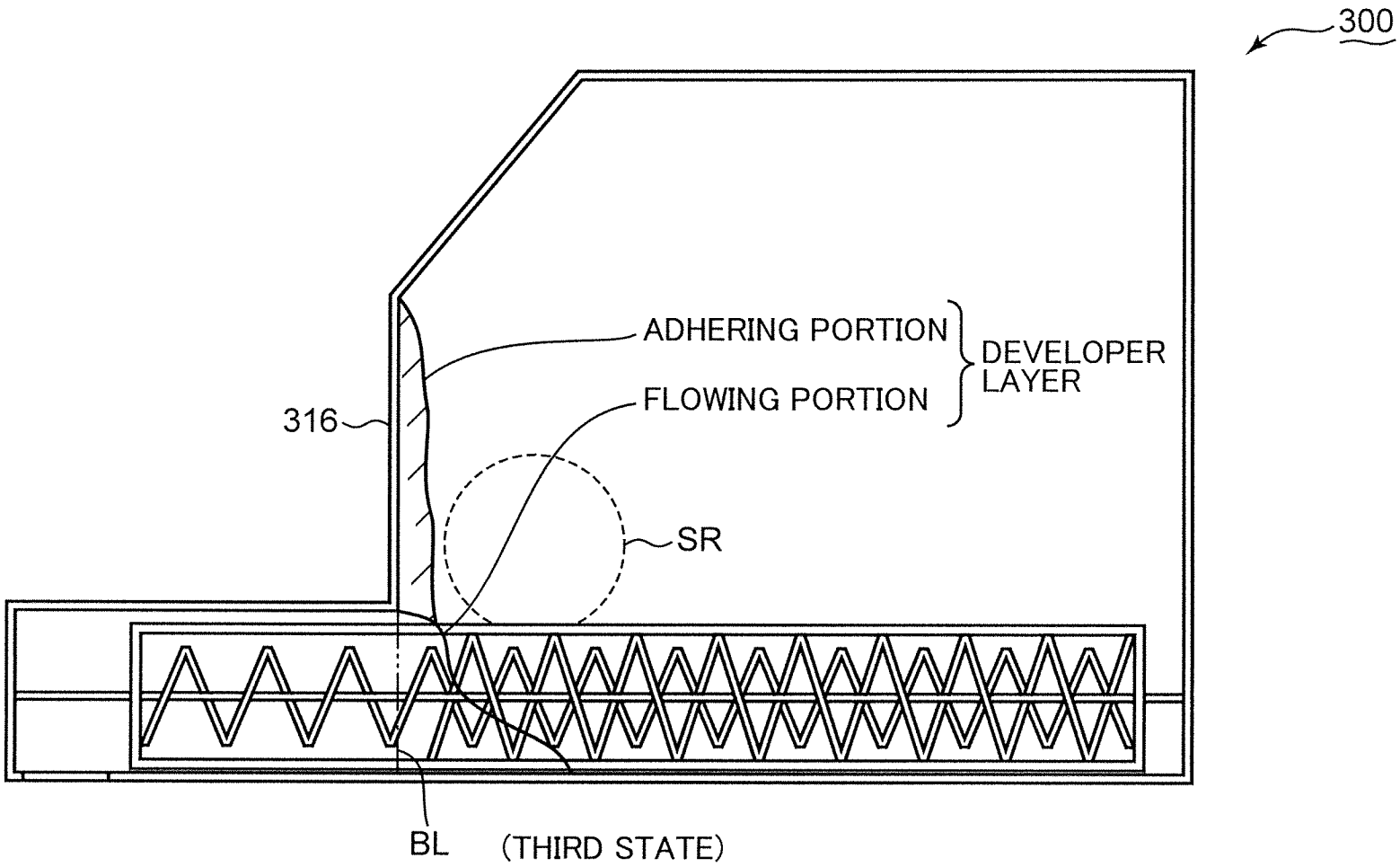
FIG. 11D is a schematic view showing a state of developer in the container shown in FIG. 8.

FIG. 11D shows the developer in a third state after the second state. In the third state, the detection region SR is entirely exposed from the developer layer. Meanwhile, the developer layer is roughly classified into an adhering portion adhered to the facing wall 316 and a flowing portion existing in a rotational area of the screw feeder 320.

Since there is the adhering layer of the developer on the facing wall 316 next to the detection region SR although the detection region SR is entirely exposed from the layer of developer, the magnetic permeability sensor 360 outputs voltage signals corresponding to the adhering layer.

Since the flowing portion of the developer which remains near the boundary BL in the primary storage portion 312 supports the adhering layer in the third state, the adhering layer keeps adhering to the facing wall 316 stably. Therefore, a value of the voltage signal from the magnetic permeability sensor 360 is substantially constant.

Figure 11E:
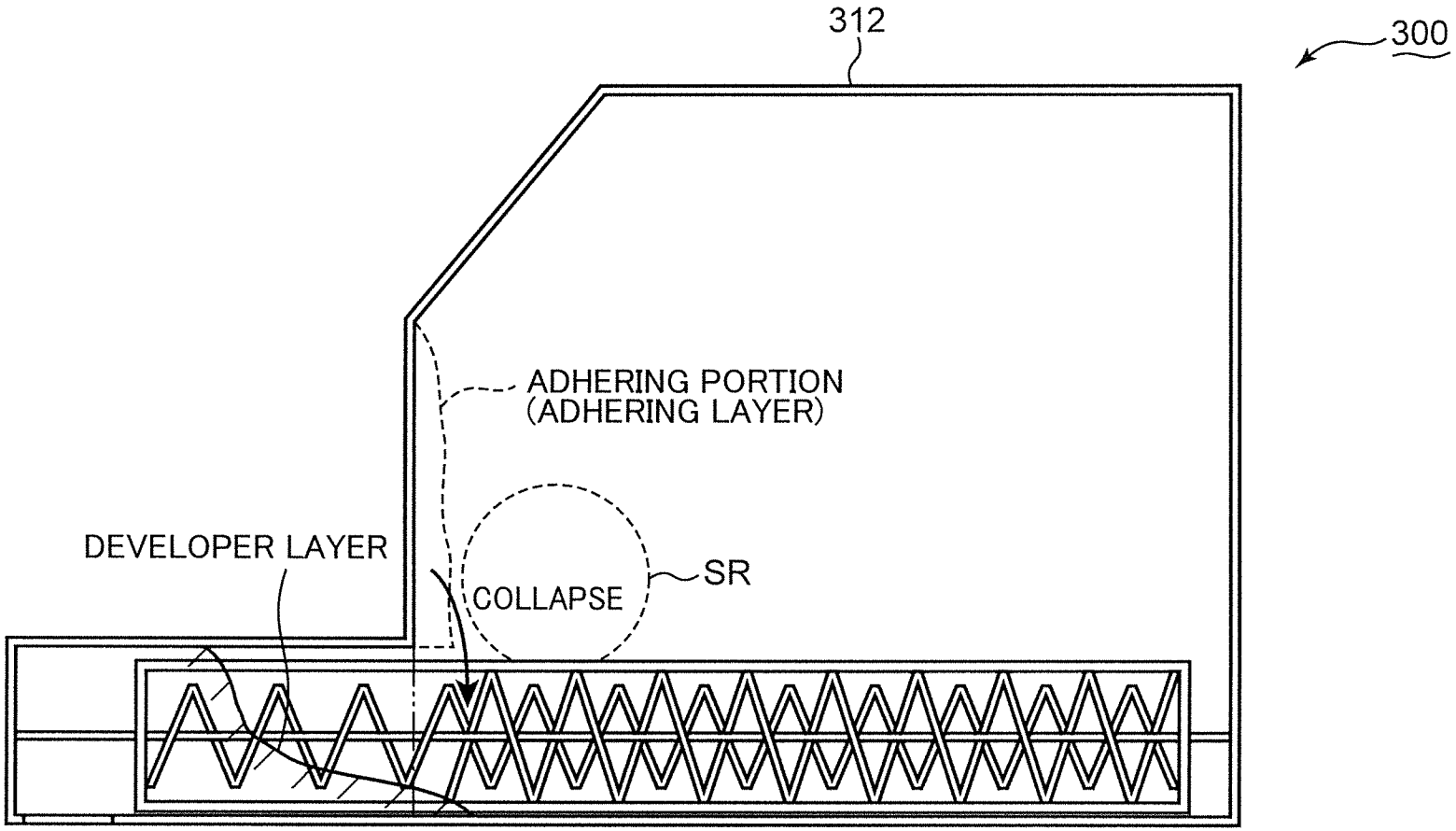
FIG. 11E is a schematic view showing a state of developer in the container shown in FIG. 8.

FIG. 11E shows the developer in a fourth state after the third state. The adhering layer described with reference to FIG. 11D collapses when the flowing portion of the developer remaining near the boundary BL in the primary storage portion 312 is gone. During the collapse of the adhering layer, a value of the voltage signal from the magnetic permeability sensor 360 decreases. Thereafter, the magnetic permeability sensor 360 outputs substantially constant voltage signals at a low level.

Figure 12:
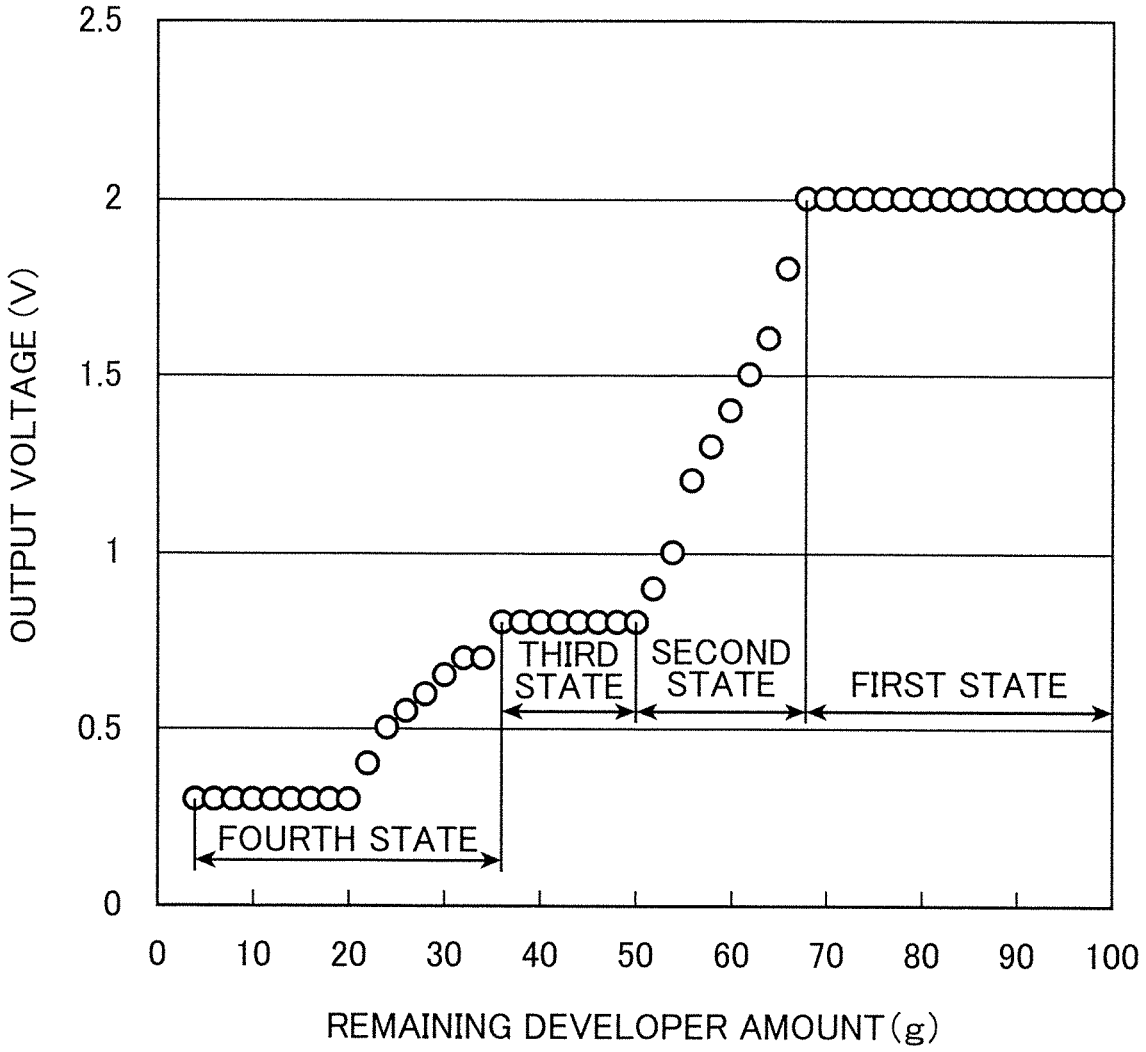
FIG. 12 is a qualitative graph showing a relationship between an amount of developer remaining in the container shown in FIG. 8 and an output voltage from a magnetic permeability sensor.

FIG. 12 is a qualitative graph showing a relationship between an amount of developer remaining in the container 300 and an output voltage from the magnetic permeability sensor 360. The conditional change in the developer in the container 300 is further described with reference to FIGS. 7 and 11A to 12.

The horizontal axis of the graph shown in FIG. 12 represents an amount of developer remaining in the container 300. The vertical axis of the graph shown in FIG. 12 represents an output voltage from the magnetic permeability sensor 360.

During the first state, the magnetic permeability sensor 360 outputs a substantially constant voltage signal at a relatively high level. During the second state, a value of the voltage signal output from the magnetic permeability sensor 360 gradually decreases. During the third state, the magnetic permeability sensor 360 outputs a substantially constant voltage signal again. A value of the voltage signal output during the third state are lower than a value of the voltage signal output during the first state. During the fourth state, a value of the voltage signal output from the magnetic permeability sensor 360 decreases again. Eventually, the magnetic permeability sensor 360 outputs a substantially constant voltage signal at a lower level than the voltage signals output during the third state. Since the magnetic permeability sensor 360 outputs different voltage signals in value in response to a state of the developer in the container 300, an appropriate timing to replace the container 300 is identified on the basis of the output voltage from the magnetic permeability sensor 360.

If the magnetic permeability sensor 360 outputs a substantially constant voltage signal at a relatively high level, it may be determined that a sufficient amount of developer remains in the container 300 (first state). Thereafter, if a value of the voltage signal from the magnetic permeability sensor 360 decreases at a change rate greater than that of the voltage signal output during the first state, it may be determined that an amount of developer in the primary storage portion 312 gradually decreases (second state). After that, if the value of the voltage signal from the magnetic permeability sensor 360 changes at a smaller rate than that of the voltage signal output during the second state, it may be determined that there remains little developer in the primary storage portion 312 while the projecting cylinder 313 is filled with developer (third state). Thereafter, if the value of the voltage signal from the magnetic permeability sensor 360 decreases at a change rate greater than that of the voltage signal output during the third state, it may be determined that replenishment of developer from the container 300 will soon become insufficient. In the present embodiment, the output voltage of the magnetic permeability sensor 360 is exemplified as the data corresponding to the physical property of the developer. The value of the output voltage of the magnetic permeability sensor 360 is exemplified as the data value.

Figure 13:
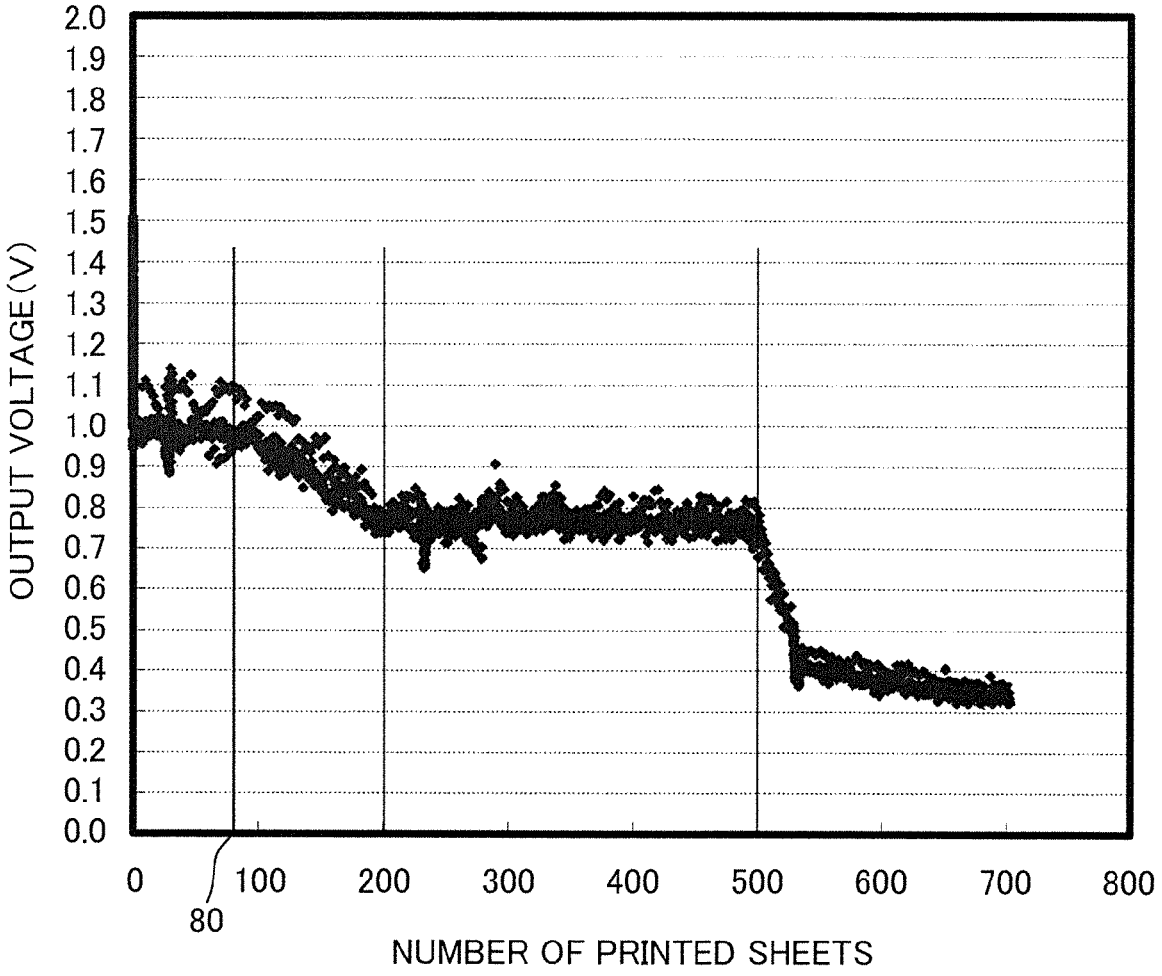
FIG. 13 is a graph showing a part of data actually output from the magnetic permeability sensor which detects an amount of developer remaining in the container shown in FIG. 8.

FIG. 13 is a graph showing a part of data actually output from the magnetic permeability sensor 360. The conditional change in the developer in the container 300 is further described with reference to FIGS. 7 and 13.

The horizontal axis of the graph shown in FIG. 13 represents the number of printed sheets. The vertical axis in FIG. 13 represents an output voltage from the magnetic permeability sensor 360.

The graph shows that the output voltage of the magnetic permeability sensor 360 is relatively high and shows a small change in a range from "0" to "80" in the number of printed sheets. The "0" in the number of printed sheets of the graph is set in order to indicate the aforementioned first to fourth states. Therefore, in a state before the "0" in the number of printed sheets, the output voltage from the magnetic permeability sensor 360 has a similar change to that shown in the range from "0" to "80" in the number of printed sheets.

The graph shows a large difference in a changing tendency (decreasing tendency) of the output voltage from the magnetic permeability sensor 360 between ranges from "0" to "80" and from "80" to "200" in the number of printed sheets. The graph also shows that the decreasing tendency of the output voltage in the range of the printed sheets "200" to "500" disappears in the range from "200" to "500" in the number of printed sheets. It is also shown that the output voltage decreases rapidly in the range exceeding "500" in the number of printed sheets.

The graph in FIG. 13 shows that the state in the range from "0" to "80" in the number of printed sheets is equivalent to the aforementioned first state. It is also shown that the state in the range from "80" to "200" in the number of printed sheets is equivalent to the second state. It is shown that the state in the range from "200" to "500" in the number of printed sheets is equivalent to the third state. It is shown that the state in the range exceeding "500" in the number of printed sheets is equivalent to the fourth state.

(Control Techniques)

Figure 14:
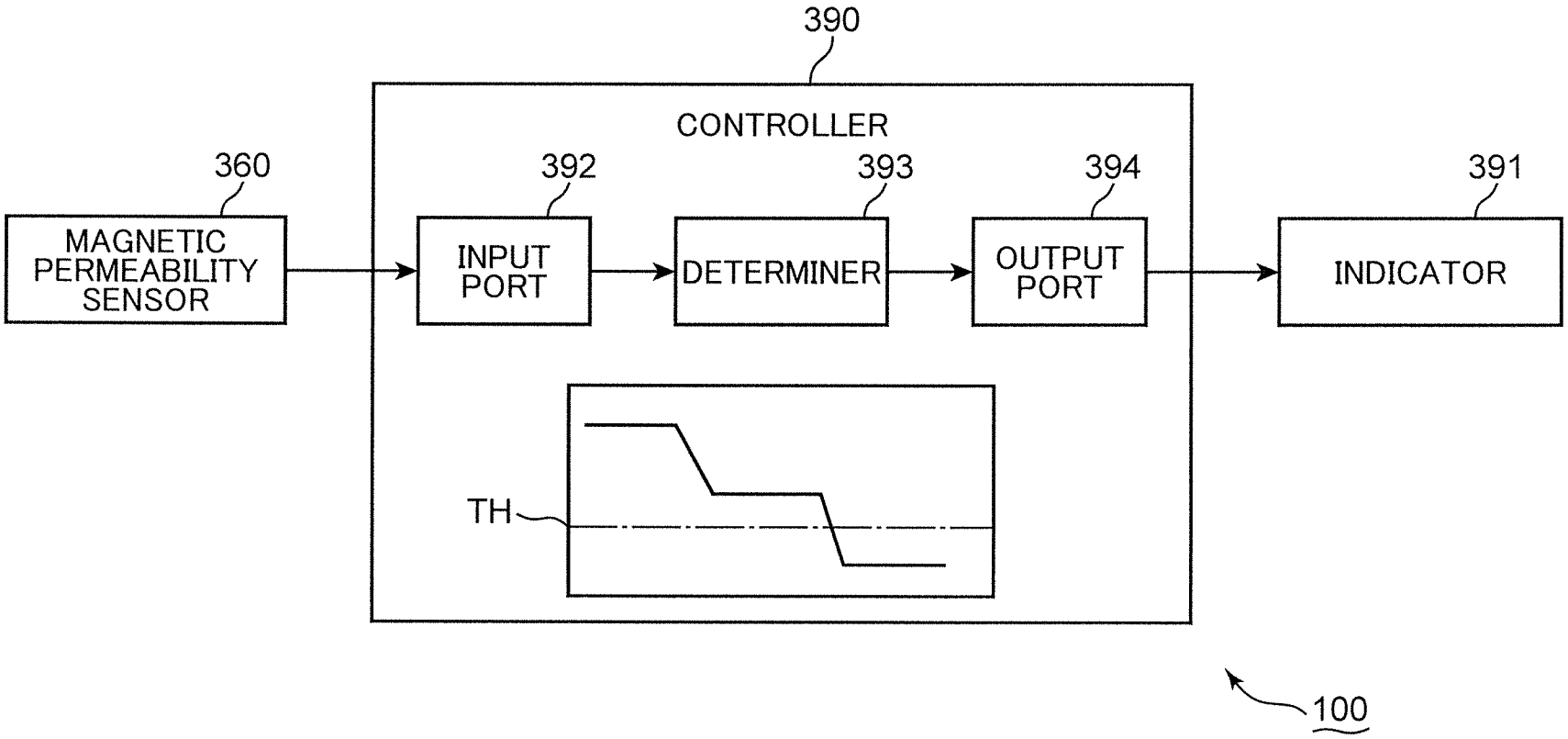
FIG. 14 is a schematic block diagram of the printer shown in FIG. 4.

FIG. 14 is a schematic block diagram of the printer 100. A control in response to output signals of the magnetic permeability sensor 360 is described with reference to FIGS. 4 and 14.

The printer 100 includes a controller 390 which performs control for notifying a user of a replacing timing of the container 300 in response to an output of the magnetic permeability sensor 360, and an indicator 391 which notifies the user of the replacing timing of the container 300 under control of the controller 390. The controller 390 includes an input port 392, which receives voltage signals from the magnetic permeability sensor 360, a determiner 393, which determines whether the indicator 391 activates or not on the basis of a level of the voltage signals received by the input port 392, and an output port 394 which outputs drive signals for driving the indicator 391.

When the input port 392 receives a voltage signal having a value lower than a threshold value TH, which is set in advance in correspondence to a rapid decrease in the voltage level at the beginning of the fourth state, the determiner 393 generates drive signals for driving the indicator 391. Otherwise, the drive signals are not generated.

The output port 394 outputs the drive signals for driving the indicator 391 to the indicator 391. For example, the indicator 391 may include a console (not shown) of the printer 100. When the drive signals are output, a message recommending replacement of the container 300 is displayed on a display of the console. Alternatively, the indicator 391 may include a light emitter, which emits light, or an acoustic element, which generates a sound in response to the drive signals. In the present embodiment, the output port 394 is exemplified as the outputter. The drive signals are exemplified as the signal for recommending replacement of the container 300.

INDUSTRIAL APPLICABILITY

The principle of the aforementioned embodiment is appropriately applicable to an apparatus which uses developer to form images.

The invention claimed is:

1. A container for supplying developer to a developing device which develops an electrostatic latent image, the container comprising:

a housing including a primary portion for storing the developer, and a secondary portion that projects from the primary portion and is connected to the developing device, the primary portion including a facing wall situated at a boundary between the primary and secondary portions so that the facing wall faces a flow of the developer moving toward the secondary portion, the primary portion further including a first end wall opposite to the facing wall and a side wall that stands between the first end wall and the facing wall, the side wall including an attachment surface and a detection area opposite to the attachment surface;

a conveying mechanism that conveys the developer in the primary portion to the secondary portion, the conveying mechanism being disposed so that the facing wall stands above the conveying mechanism; and a detector attached to the attachment surface of the side wall and situated above the conveying mechanism and next to the facing wall, the detector being configured to detects a physical property of the developer that changes in response to an amount of the developer and outputs data corresponding to the detected physical property, wherein the developer includes a flowing portion conveyed to the secondary portion by the conveying mechanism, and an adhering portion forming an adhering layer made of the developer adhered to the facing wall, and the detector detects: a decrease of the flowing portion, a decrease of the adhering portion, and a collapse of the adhering layer due to an absence of the flowing portion below the adhering layer and wherein the detector outputs data corresponding to the detected physical property and outputs different data values among a first state, in which the developer covers the detection area, a second state, in which the developer covers a part of the detection area, a third state, in which the detection area is exposed from the developer, and a fourth state, in which the adhering layer is collapsed.

2. The container according to claim 1, further comprising a pressing mechanism that presses the detector against the attachment surface.

3. The container according to claim 1, wherein the conveying mechanism includes a conveying screw mechanism that uses a spiral blade to convey the developer from the primary portion to the secondary portion.

4. The container according to claim 3, wherein the secondary portion includes a second end wall opposite to the first end wall, and the conveying screw mechanism includes a rotary shaft, that extends between the first and second end walls, and a first spiral blade that winds around the rotary shaft so as to convey the developer from the primary portion to the secondary portion with rotation of the rotary shaft.

5. The container according to claim 4, wherein the conveying screw mechanism includes a second screw blade that winds around the rotary shaft so as to return the developer from the secondary portion to the primary portion while the first screw blade conveys the developer from the primary portion to the secondary portion.

6. The container according to claim 4, further comprising:

a cleaner that rubs the detection area to remove the developer adhered to the detection area with the rotation of the rotary shaft.

7. The container according to claim 1, wherein the developer has magnetism, and the detector has a magnetic permeability sensor.

8. The container according to claim 1, wherein the secondary portion includes a connector connected to the developing device, and the connector is formed with a supply port for allowing the developer to fall into the developing device.

9. An image forming apparatus, comprising:

a developing device that develops an electrostatic latent image to form an image; and a container for supplying developer to the developing device, the container including:

a housing including a primary portion for storing the developer, and a secondary portion that projects from the primary portion and is connected to the developing device, the primary portion including a facing wall situated at a boundary between the primary and secondary portions so that the facing wall faces a flow of the developer moving toward the secondary portion, the primary portion further including a first end wall opposite to the facing wall and a side wall that stands between the first end wall and the facing wall, the side wall including an attachment surface and a detection area opposite to the attachment surface;

a conveying mechanism that conveys the developer in the primary portion to the secondary portion, the conveying mechanism being disposed so that the facing wall stands above the conveying mechanism; and a detector attached to the attachment surface of the side wall and situated above the conveying mechanism and next to the facing wall, the detector being configured to detects a physical property of the developer that changes in response to an amount of the developer and outputs data corresponding to the detected physical property, wherein the developer includes a flowing portion conveyed to the secondary portion by the conveying mechanism, and an adhering portion forming an adhering layer made of the developer adhered to the facing wall, and the detector detects a decrease of the flowing portion, a decrease of the adhering portion and a collapse of the adhering layer due to an absence of the flowing portion below the adhering layer and wherein the detector outputs data corresponding to the detected physical property and outputs different data values among a first state, in which the developer covers the detection area, a second state, in which the developer covers a part of the detection area, a third state, in which the detection area is exposed from the developer, and a fourth state, in which the adhering layer is collapsed.

10. The image forming apparatus according to claim 9, further comprising an outputter that outputs a signal for recommending replacement of the container by use of a threshold value that is determined in correspondence with the data value output during the fourth state.

11. A container for supplying developer to a developing device that develops an electrostatic latent image, the container comprising:

a housing including a primary portion for storing the developer, and a secondary portion that projects from the primary portion and is connected to the developing device;

a conveying mechanism that conveys the developer in the primary portion to the secondary portion; and a detector that detects a state of the developer, wherein the primary portion includes a facing wall situated at a boundary between the primary and secondary portions so that the facing wall faces a flow of the developer moving toward the secondary portion, the conveying mechanism is inserted partially into the secondary portion, and the conveying mechanism includes a conveying screw mechanism that uses a spiral blade to convey the developer from the primary portion to the secondary portion, the developer includes a flowing portion conveyed to the secondary portion by the conveying mechanism, and an adhering portion forming an adhering layer made of the developer adhered to the facing wall, and the detector detects a decrease of the flowing portion and a decrease of the adhering portion individually.

12. The container according to claim 11, wherein the primary portion includes a first end wall opposite to the facing wall, the secondary portion includes a second end wall opposite to the first end wall, and the conveying screw mechanism includes a rotary shaft that extends between the first and second end walls, a first spiral blade that winds around the rotary shaft so as to convey the developer from the primary portion to the secondary portion with rotation of the rotary shaft and a second spiral blade that winds around the rotary shaft so as to return the developer from the secondary portion to the primary portion while the first spiral blade conveys the developer from the primary portion to the secondary portion.

13. The container according to claim 12, wherein the detector is closer to the facing wall then the first end wall.

* * * * *